US007175057B2

(12) United States Patent
Mutterle

(10) Patent No.: US 7,175,057 B2
(45) Date of Patent: Feb. 13, 2007

(54) DROPPER BOTTLE

(75) Inventor: Antonio Mutterle, Breganzona (CH)

(73) Assignee: IBSA Institut Biochimique SA, Lugano (CH)

( * ) Notice: Subject to any disclaimer, the term of this patent is extended or adjusted under 35 U.S.C. 154(b) by 0 days.

(21) Appl. No.: 11/044,709

(22) Filed: Jan. 28, 2005

(65) Prior Publication Data

US 2005/0184104 A1 Aug. 25, 2005

(30) Foreign Application Priority Data

Feb. 5, 2004 (EP) ..... 04075346

(51) Int. Cl.
*B65D 47/18* (2006.01)

(52) U.S. Cl. ..... 222/420; 222/570; 215/274; 215/256; 215/344

(58) Field of Classification Search ..... 222/420, 222/546, 569, 570, 567, 421; 215/321.7, 215/256, 344, 345, 346, 343, 316, 320, DIG. 1
See application file for complete search history.

(56) References Cited

U.S. PATENT DOCUMENTS 455,916 A * 7/1891 Leoncavallo et al. ..... 235/13
4,773,551 A * 9/1988 Rizzardi ..... 215/253
5,871,128 A 2/1999 Carroll
6,102,225 A * 8/2000 Lynn ..... 215/252

FOREIGN PATENT DOCUMENTS

| | | |
|---|---|---|
| FR | 1266243 | 5/1961 |
| FR | 2600629 | 12/1987 |
| GB | 839285 | 6/1960 |
| GB | 2263107 | 7/1993 |

* cited by examiner

*Primary Examiner*—Kevin Shaver
*Assistant Examiner*—Stephanie E. Tyler
(74) *Attorney, Agent, or Firm*—Nixon & Vanderhye, P.C.

(57) ABSTRACT

An improved dropper bottle, and in particular a dropper body able to be joined to a container body and closed by a cap, are described. The dropper body comprises a first droplet delivery end and an open base, the open base of the dropper body comprising a first projection able to engage with the internal surface of a mouth of the container body, and a second projection able to engage with the external surface of the mouth of the container body. Locking toothing is provided between the dropper body and the container body.

10 Claims, 5 Drawing Sheets

DROPPER BOTTLE

CROSS-REFERENCE TO RELATED APPLICATIONS

This application is based on European Patent Application No. 04075346.9 filed on Feb. 5, 2004, the content of which is incorporated hereinto by reference.

BACKGROUND OF THE INVENTION

1. Field of Invention

The present invention relates to a dropper bottle or the like and in particular a dropper body for such a bottle.

2. Description of the Prior Art

As is known, many fluids are dosed or administered by means of dropper bottles. In particular, dosing in the form of droplets is particularly widespread in the pharmaceutical or para-pharmaceutical field for administering in a precise manner a drug for oral or topical use, for example nasal, ophthalmic or otological use. Dosing in droplets is also very commonly used for dosing aromatic, balsamic or similar products.

A known dropper bottle comprises a fluid container body, a stem, a collar and a cap. The container body generally has a substantially cylindrical shape with a closed bottom and mouth open at the top. Usually it is made of glass, polyethylene terephthalate or the like.

The dropper body or stem comprises a top part with an elongated form which terminates in a droplet outlet orifice and a bottom base which rests on the top part of the mouth of the container body. The stem is held in position by the collar which engages with the external bottom edge of the mouth of the container body and is externally threaded.

When the dropper bottle is not in use, in particular when it is sealingly closed before being sold, a closed cap is fitted onto the stem/collar assembly. The top of the cap is provided, internally, with an elongated projection which penetrates into the orifice of the stem so as to close it. Generally, a threading is provided between the collar of the stem and the cap. In other words, in order to remove the cap, it is necessary to unscrew it from the collar. Finally, in order to ensure that the product contained in the container bottle is not tampered with, a locking ring (seal of guarantee) is provided at the bottom of the cap and must be removed by means of tearing by the user when the dropper bottle is first opened.

A dropper bottle of the type described above is considered to be fairly simple to produce and assemble. However, the Applicant has noted a series of problems and has perceived the need to improve the known dropper bottles.

Firstly, the Applicant has noted undesirable and unacceptable problems as regards the seal between stem and container body, between container body and collar and between collar and stem. The main cause of these problems is considered to be the imperfect adhesion between the mouth of the container body and the base of the stem.

Secondly, the Applicant noted that in many cases it was difficult to unscrew the cap from the collar of the stem because the latter was not locked sufficiently tightly with respect to the container body and rotated idly.

Thirdly, the Applicant noted that in many cases it was difficult to remove by means of tearing the sealing ring fastened to the cap because the latter rotated idly with respect to the collar, which was in turn not adequately locked with respect to the container body.

BRIEF SUMMARY

The present technology features dropper bottle which is substantially leak-free and can be easily opened, in particular when used for the first time, and which solves the abovementioned problems.

According to a first aspect of the present technology, a dropper body for a dropper bottle is provided. The dropper body is able to be joined to a container body and closed by a cap. The dropper body comprises a first droplet delivery end and an open base, the open base of the dropper body comprising: a first projection able to engage with the internal surface of a mouth of the container body, and a second projection able to engage with the external surface of the mouth of the container body, and a bearing surface able to engage with the upper surface of the mouth of the container body. The mouth of the container body is penicillin-type. The second projection comprises a substantially continuous protuberance which is able to engage with a continuous bottom edge of the external surface of the mouth of the container body. The dropper body further comprises at least one cavity on the bearing surface co-operating with at least one corresponding protuberance formed on an upper surface of the mouth of the container body or at least one protuberance protruding from the bearing surface and co-operating with at least one corresponding cavity formed on an upper surface of the mouth of the container body.

Preferably, the first projection extends at least about 1.5 mm from the said bearing surface. More preferably, it extends at least about 2.5 mm from the said bearing surface.

Preferably, the dropper body according to the present technology is made of polyethylene approved by the pharmacopoeia.

According to a second aspect, the present technology provides a dropper bottle comprising a dropper body as set forth below, a cap, and a container body. The container body comprises a penicillin-type mouth having an external surface, an internal surface and an upper surface, with at least one protuberance or cavity being formed on said upper surface. The cap further comprises a locking ring with a device for preventing relative rotation of said cap and said dropper body.

Preferably, the device preventing relative rotation of said cap and said dropper body comprises at least one protuberance and at least one corresponding cavity.

Preferably, said at least one protuberance is formed on an internal surface of a bottom ring and said at least one corresponding cavity is formed on the second external projection.

According to a preferred embodiment, the dropper body comprises a thread and said cap comprises a corresponding thread for a screwed mutual connection.

Typically, the dropper bottle is used for containing drugs for oral, nasal, ophthalmic, otological use. It can also be used for containing balsamic products or the like.

The present invention will become clear from the detailed description which follows, provided purely by way of a non-limiting example, with reference to the various figures.

DETAILED DESCRIPTION

Figure 1:
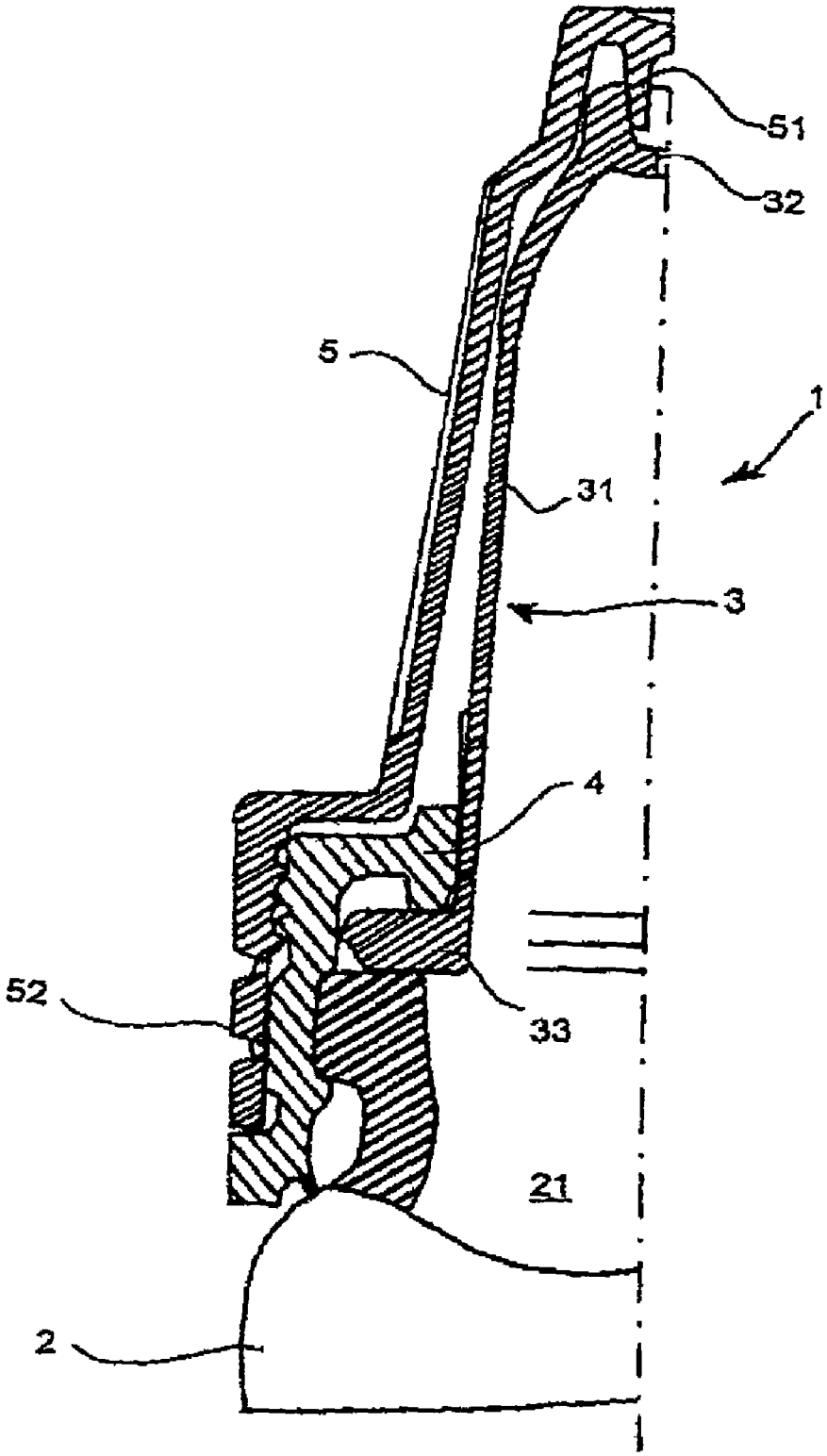
FIG. 1 (Prior Art)
FIG. 1 shows a partial longitudinal cross-section through a prior art dropper bottle.
Figure 2:
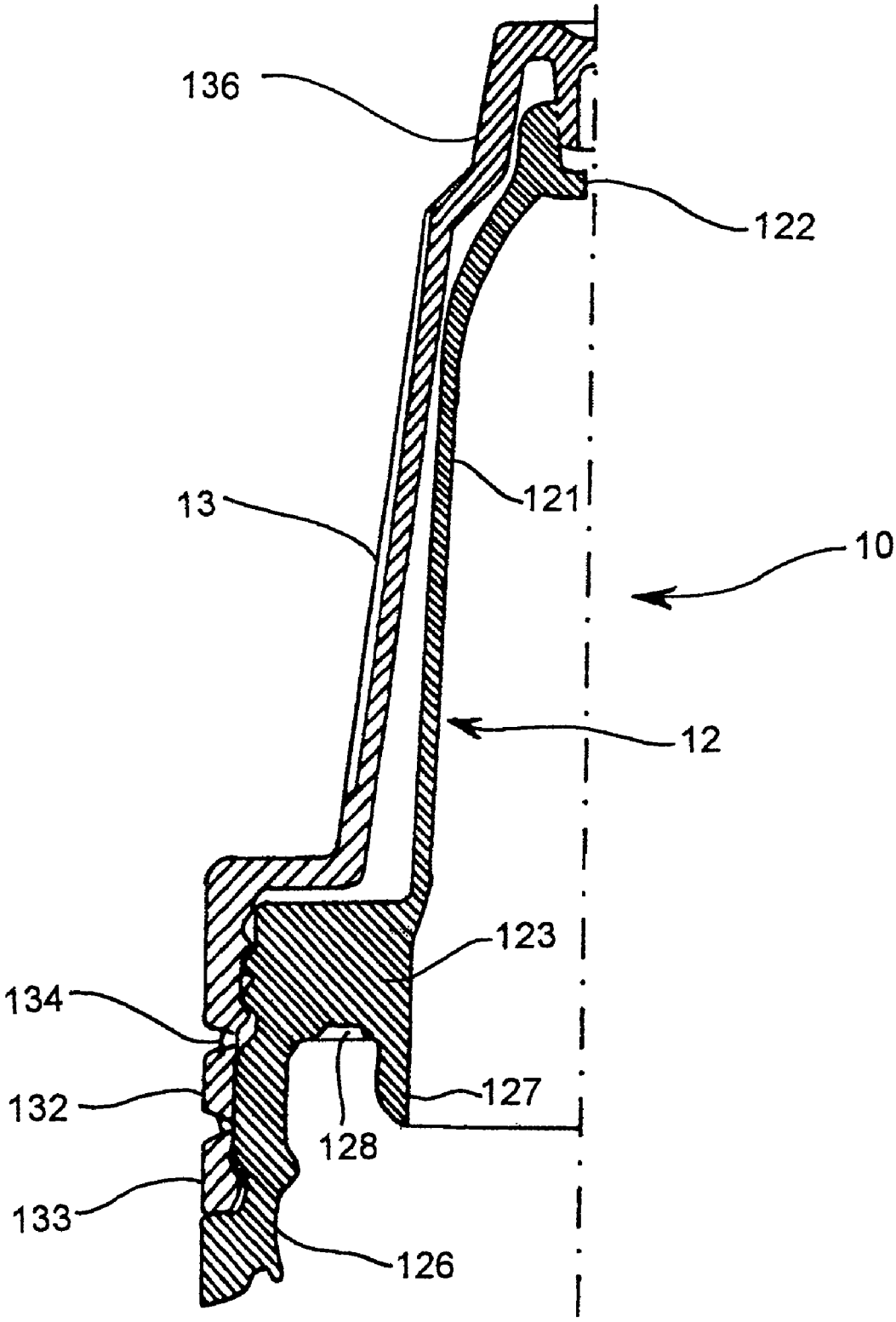
FIG. 2 shows a partial longitudinal cross-section through a dropper body and a cap for a dropper bottle according to the present technology.

As mentioned above, a prior art dropper bottle 1 (illustrated in FIG. 1) comprises a body 2 containing a fluid, a stem 3, a collar 4 and a cap 5. The container body 2 generally has a substantially cylindrical shape with a closed bottom and a mouth 21 open at the top.

The stem 3 comprises a top part 31 with an elongated shape which terminates in a droplet outlet orifice 32 and a bottom base 33 which rests on the top part of the mouth 21 of the container body 2. The stem is kept in position by the collar 4 which engages with the external bottom edge of the mouth 21 of the container body 2 and is externally threaded.

When the dropper bottle 1 is not in use, in particular when it is sealingly closed before being sold, a closed cap 5 is fitted onto the stem/collar assembly. The top of the cap 5 is provided, internally, with an elongated projection 51 which penetrates into the orifice 32 of the stem 3 and closes it. Generally, a thread is provided between the collar 4 of the stem 3 and the cap 5. In other words, in order to remove the cap 5 it is necessary to unscrew it from the collar 4. Finally, in order to ensure that the product contained in the container bottle is not tampered with, a locking ring 52 (also called "seal of guarantee") is provided at the bottom of the cap 5 and must be removed by means of tearing by the user when the dropper bottle 1 is first opened.

According to the present technology, with reference to FIGS. 2–7, the stem and the collar are formed as a single piece which, in the remainder of this description, will be referred to as "dropper body". Therefore, a dropper bottle 10 according to the present technology comprises a container body 11, a dropper body 12 and a cap 13. The dropper body 12 has an elongated part 121, an orifice 122 at the end of the elongated part 121 and a base part 123 at its opposite end.

Figure 6:
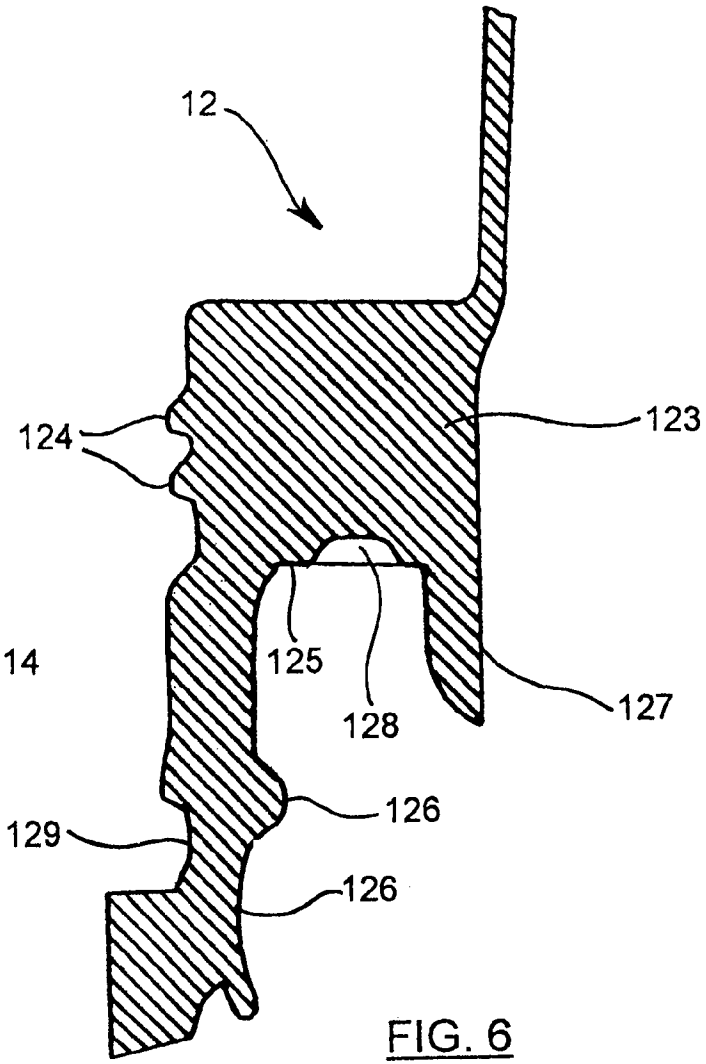
FIG. 6 shows an enlarged partial longitudinal cross-section through the terminal part of the dropper body according to the present technology.
Figure 5:
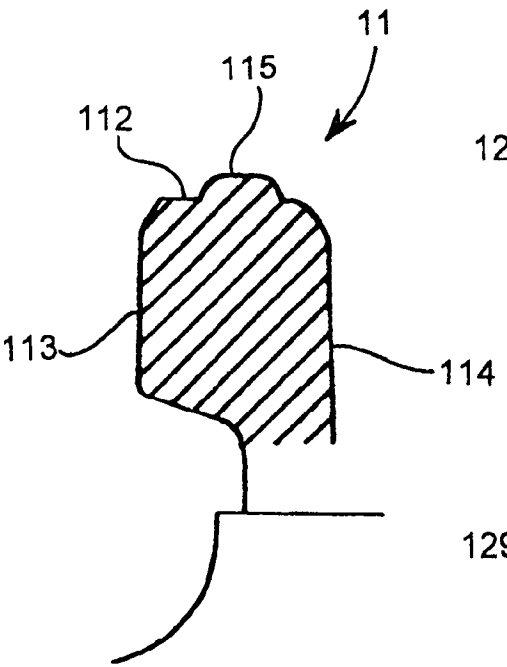
FIG. 5 shows an enlarged partial longitudinal cross-section through the mouth of the container body which can be joined to the dropper body according to the present technology.
Figure 4:
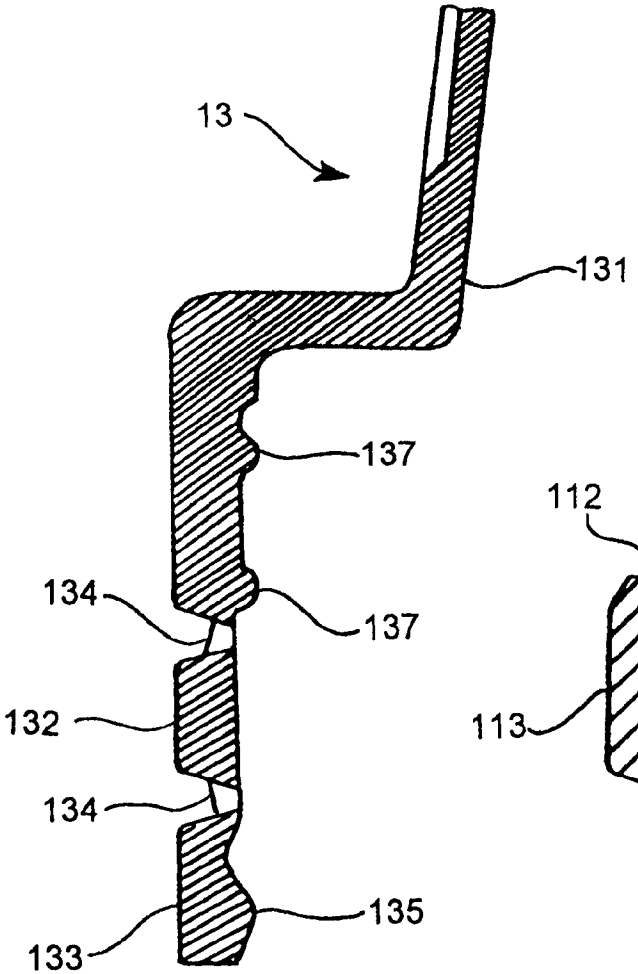
FIG. 4 shows an enlarged partial longitudinal cross-section through the terminal part of the cap according to the present technology.
Figure 7:
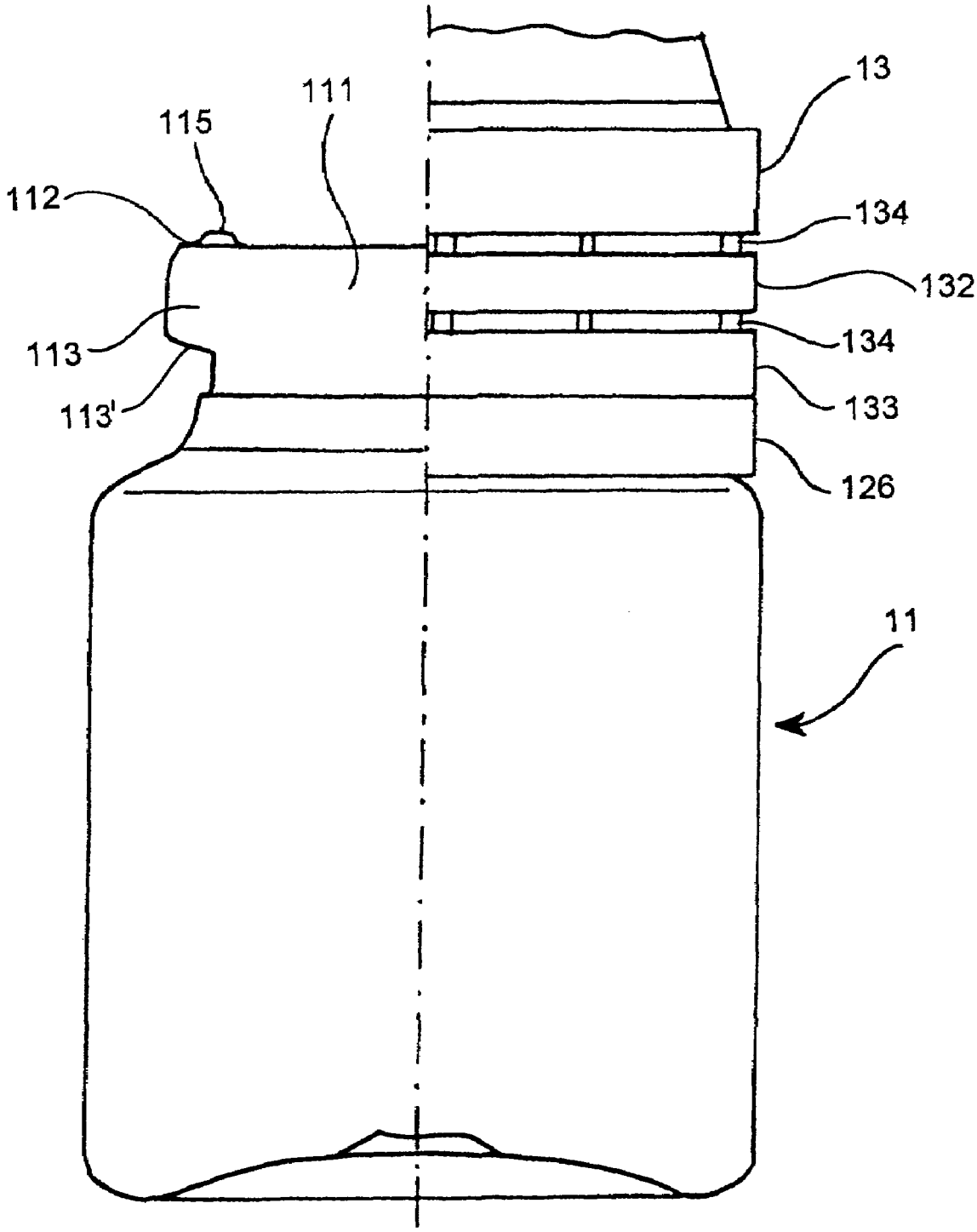
FIG. 7 shows a partial longitudinal cross-section through a container body for a dropper bottle according to the present technology.

As clearly shown in FIGS. 4, 5 and 6, the base part 123 is provided with an external thread (124) so that it can be screwed to a thread 137 of the cap 13. The base part 123 comprises a bearing surface 125, a first internal projection 127 and a second external projection 126. The bearing surface 125 is able to rest on the upper surface 112 of the mouth 111 of the container body 11. The external projection 126 is able to engage with the external surface 113 of the mouth 111 of the container body 11. In particular, a circular and continuous protuberance 126' is provided in the external projection 126, at a distance from bearing surface 125. Such a protuberance 126' is designed for engaging with a bottom edge 113' of the external surface 113 of the mouth 111 of the container body 11. Thanks to the cooperation between protuberance 126' and bottom edge 113', the user does not run any risk to disassemble the dropper body 12 from the container body when they are assembled together.

Finally, the internal projection 127 is able to engage with the internal surface 114 of the mouth 111 of the container body 11. In other words, the bearing surface 125, the external projection 126 and the internal projection 127 define an annular cavity which can be fitted onto the mouth 111 of the container body 11. Conveniently, the mouth 111 of the container body of the dropper bottle 10 according to the present invention is of the type commonly known as "penicillin type".

Preferably, the first and the second projections 126, 127 are substantially circular projections. Preferably, the first and the second projections 126, 127 are substantially circular, continuous, projections.

Preferably, the first (internal) projection 127 extends at least about 1.5 mm from the bearing surface 125. Even more preferably it extends at least about 2.5 mm.

Preferably, the dropper body is made of polyethylene approved by the pharmacopoeia, with elasticity and hardness characteristics which are suitable for use.

Figure 3:
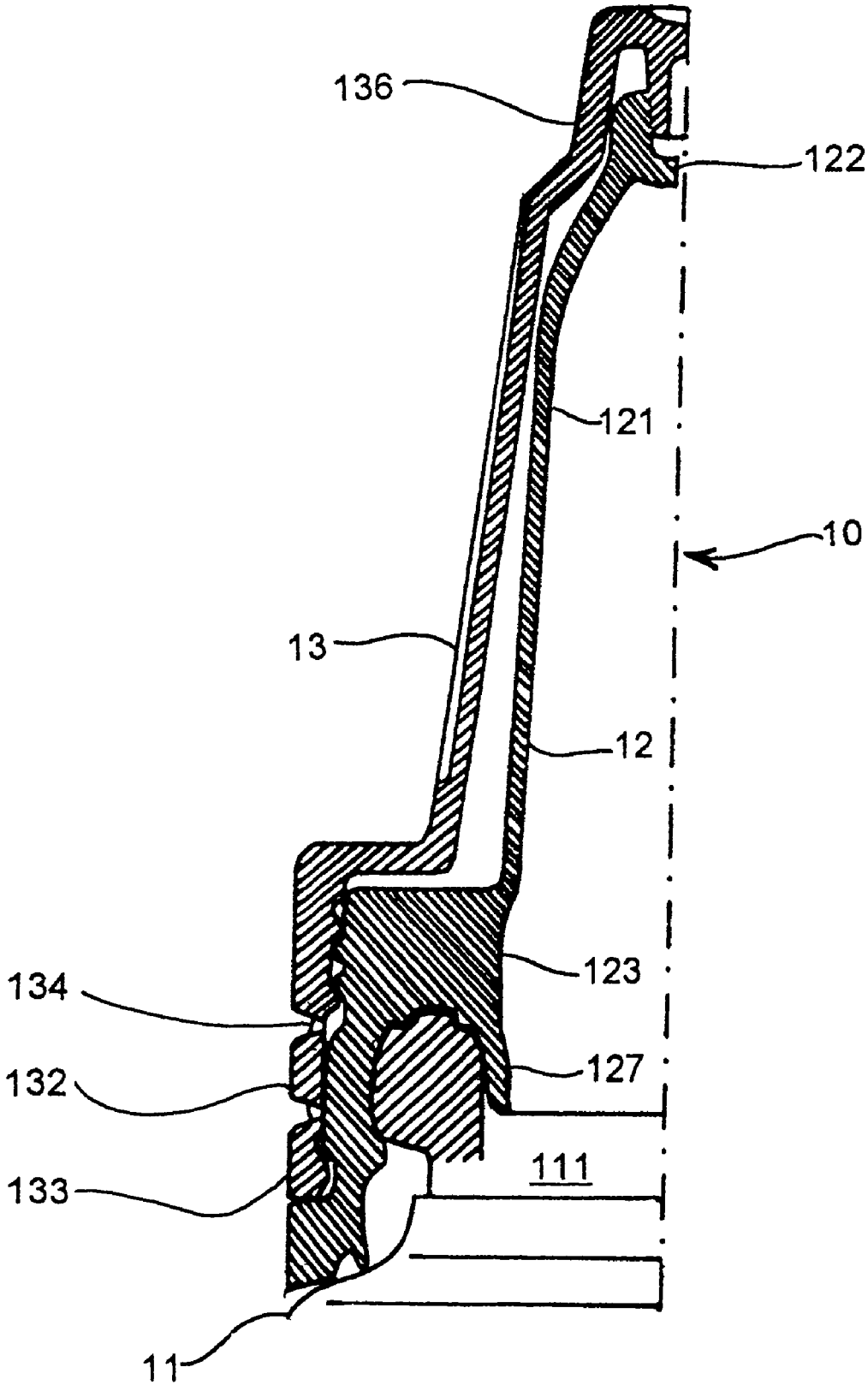
FIG. 3 shows a partial longitudinal cross-section through a dropper bottle according to the present technology.

According to the present technology, the annular cavity formed by means of the internal projection 127, the external projection 126 and the bearing surface 125, together with the elasticity of the material used, provides an effective seal against losses or leakages (FIG. 3). Advantageously, according to the present technology, the seal is also ensured even if the mouth of the container body is not manufactured precisely.

According to a first preferred embodiment, the bearing surface 125 of the dropper body 12 comprises at least one cavity 128 co-operating with at least one corresponding protuberance 115 on the upper surface 112 of the mouth 111 of the container body 11. Preferably, a plurality of cavities 128 and a corresponding plurality of protuberances 115 are provided so as to form a kind of toothing.

According to a second embodiment (not shown), the bearing surface 125 of the dropper body 12 comprises at least one protuberance co-operating with at least one corresponding cavity on the upper surface of the mouth 111 of the container body 11. Preferably, a plurality of cavities and a corresponding plurality of protuberances are provided so as to form a kind of toothing able to prevent relative rotation of the dropper body 12 and the container body 11.

According to a third embodiment (not shown), the external surface 113 of the mouth 111 of the container body 11 comprises at least one protuberance co-operating with at least one corresponding cavity on the external projection 126. Preferably a plurality of cavities and a corresponding plurality of protuberances are provided so as to form a kind of toothing preventing relative rotation of the dropper body 12 and the container body 11.

According to a fourth embodiment (not shown), the external surface 113 of the mouth 111 of the container body 11 comprises at least one cavity co-operating with at least one corresponding protuberance on the external projection 126. Preferably, a plurality of cavities and a corresponding plurality of protuberances are provided so as to form a kind of toothing preventing relative rotation of the dropper body 12 and the container body 11.

Owing to this system of cavities and protuberances, the dropper body 12 cannot rotate relative to the container body 11, and the cap 13 can be easily screwed or unscrewed.

The cap 13 also comprises, in the vicinity of its open end 131, a locking ring (seal of guarantee) 132 which must be removed by means of tearing by the user upon initial opening of the dropper bottle 10. The locking ring 132 is connected to a bottom ring 133 and to the remainder of the cap at a certain number of points 134 which form weakening lines.

According to a further aspect of the present technology, a toothing for preventing relative rotation of the dropper body 12 and the cap 13 is provided in the region of the bottom ring 133. According to the present technology, cavities 129 are formed in the bottom part of the external projection 126 of the dropper body 12 and corresponding protuberances 135 are formed in the inner side of the bottom ring 133. Owing to this toothing preventing relative rotation of the dropper body 12 and the cap 13, removal of the locking ring 132 is favoured since the top part 136 of the cap cannot rotate when the locking ring 132 is torn.

The present invention may be subject to numerous modifications, adaptations, variations and replacements of parts with other functionally equivalent parts without thereby departing from the scope of protection defined by the following claims.

What is claimed is:

1. A dropper body for a dropper bottle, said dropper body being able to be joined to a container body and closed by a cap, the dropper body comprising a first droplet delivery end and an open base, wherein the open base of the dropper body comprises:

a first projection able to engage with an internal surface of a mouth of the container body, a second projection able to engage with an external surface of the mouth of the container body, and a bearing surface able to engage with an upper surface of the mouth of the container body, wherein said mouth of the container body comprises a continuous annular outer flange;

wherein said continuous annular outer flange comprises a continuous bottom edge;

wherein said second projection comprises a substantially continuous protuberance which is able to engage with said continuous bottom edge;

wherein said dropper body further comprises either:

at least one cavity on the bearing surface, said at least one cavity being adapted to co-operate with at least one corresponding protuberance formed on the upper surface of the mouth of the said container body for providing a locking toothing between said dropper body and said container body; or at least one protuberance protruding from the bearing surface, said at least one protuberance being adapted to co-operate with at least one corresponding cavity formed on the upper surface of the mouth of the container body for providing a locking toothing between said dropper body and said container body.

2. The dropper body of claim 1, wherein the first projection extends at least about 1.5 mm from the said bearing surface.

3. The dropper body of claim 1, wherein the first projection extends at least about 2.5 mm from the said bearing surface.

4. The dropper body of claim 1, wherein it is made of polyethylene approved by the pharmacopoeia.

5. A dropper bottle comprising:

a dropper body according to claim 1, a cap, and a container body, wherein said container body comprises a mouth having a continuous annular outer flange, an external surface, an internal surface and an upper surface, wherein said cap further comprises a locking ring with a device for preventing relative rotation of said cap and said dropper body.

6. The dropper bottle of claim 5, wherein said device preventing relative rotation of said cap and said dropper body comprises at least one protuberance and at least one corresponding cavity.

7. The dropper bottle of claim 6, wherein said at least one protuberance is formed on an internal surface of a bottom ring and said at least one corresponding cavity is formed on the second external projection.

8. The dropper bottle of claim 5, wherein said dropper body comprises a thread and said cap comprises a corresponding thread for a screwed mutual connection.

9. The dropper bottle of claim 5, wherein it is used for one of the following uses: drug for oral, nasal, ophthalmic, otological, balsamic or similar use.

10. The dropper body of claim 1, wherein said dropper body comprises either:

a plurality of cavities on said bearing surface, said plurality of cavities being adapted to co-operate with a plurality of corresponding protuberances formed on said upper surface of the mouth of said container body for providing a locking toothing between said dropper body and said container body; or a plurality of protuberances protruding from said bearing surface, said plurality of protuberances being adapted to co-operate with a plurality of corresponding cavities formed on said upper surface of the mouth of said container body for providing a locking toothing between said dropper body and said container body.

* * * * *